United States Patent [19]

Syler

[11] Patent Number: 4,505,231

[45] Date of Patent: Mar. 19, 1985

[54] WATER HEATER CONSTRUCTION WITH SEDIMENT REMOVAL MEANS

[75] Inventor: Rodney R. Syler, Fairview, Tenn.

[73] Assignee: Apcom, Inc., Franklin, Tenn.

[21] Appl. No.: 589,948

[22] Filed: Mar. 15, 1984

[51] Int. Cl.[3] ..... F22B 7/00

[52] U.S. Cl. ..... 122/159; 122/17; 122/383

[58] Field of Search ..... 122/381, 382, 383, 384, 122/390, 13 R, 159, 17

[56] References Cited

U.S. PATENT DOCUMENTS

| | | | |
|---|---|---|---|
| 822,575 | 6/1906 | Broman | 122/383 |
| 4,257,355 | 3/1981 | Cook | 122/17 |
| 4,263,879 | 4/1981 | Lindahl | 122/159 |

*Primary Examiner*—Edward G. Favors

*Attorney, Agent, or Firm*—Michael, Best & Friedrich

[57] ABSTRACT

A water heater including a water tight tank and a source of heat for heating water inside the tank. A hot water outlet is located in the top of the tank. An inlet agitator tube is mounted in the tank. The tube includes a straight vertical portion, a first curved portion lying in a vertical plane and a second curved portion lying in a horizontal plane adjacent the bottom of the tank. The second curved portion has a plurality of openings in the underside thereof through which streams of water will be directed into the tank each time water is drawn out of the top of the tank, said streams of water serving to agitate the water in the bottom of the tank to prevent accumulation of sediment therein.

8 Claims, 9 Drawing Figures

WATER HEATER CONSTRUCTION WITH SEDIMENT REMOVAL MEANS

BACKGROUND OF THE INVENTION

1. Field of the Invention

This invention relates to a water heater construction having a means for preventing the accumulation of solid particles in the bottom portion of the water heater. The water heater construction of the present invention is designed particularly for use in residential-type water heaters, i.e., water heaters of a smaller size than commercial water heaters.

2. Description of the Prior Art

Prior water heater constructions directed to the problem of sediment accumulation are disclosed in U.S. Pat. Nos. 4,157,077, 4,263,879, 4,257,355 and in application Ser. No. 498,019 filed May 25, 1983. The principal object of the present invention is to provide means for preventing sediment accumulation in a water heater which is of a simple construction and can be used effectively in residential-type water heaters.

SUMMARY OF THE INVENTION

A water heater including a water tight tank and a source of heat for heating water inside the tank and a hot water outlet located in the top of the tank. A tubular agitator means is mounted in the tank, which includes a straight vertical portion, a first curved portion lying in a substantially vertical plane and a second curved portion lying in a substantially horizontal plane adjacent the bottom of the tank. The straight vertical portion extends through the top of the tank and is adapted for connection to a source of water under pressure. The second curved portion has a plurality of openings therein through which streams of water will be directed into the tank each time water is drawn out of the top of the tank. Such streams of water are directed in the same general direction as the water flowing through the tube itself to thereby produce a swirling action in the bottom portion of the tank, which swirling action is effective to prevent accumulation of sediment in the tank.

DESCRIPTION OF THE PREFERRED EMBODIMENT

Figure 1:
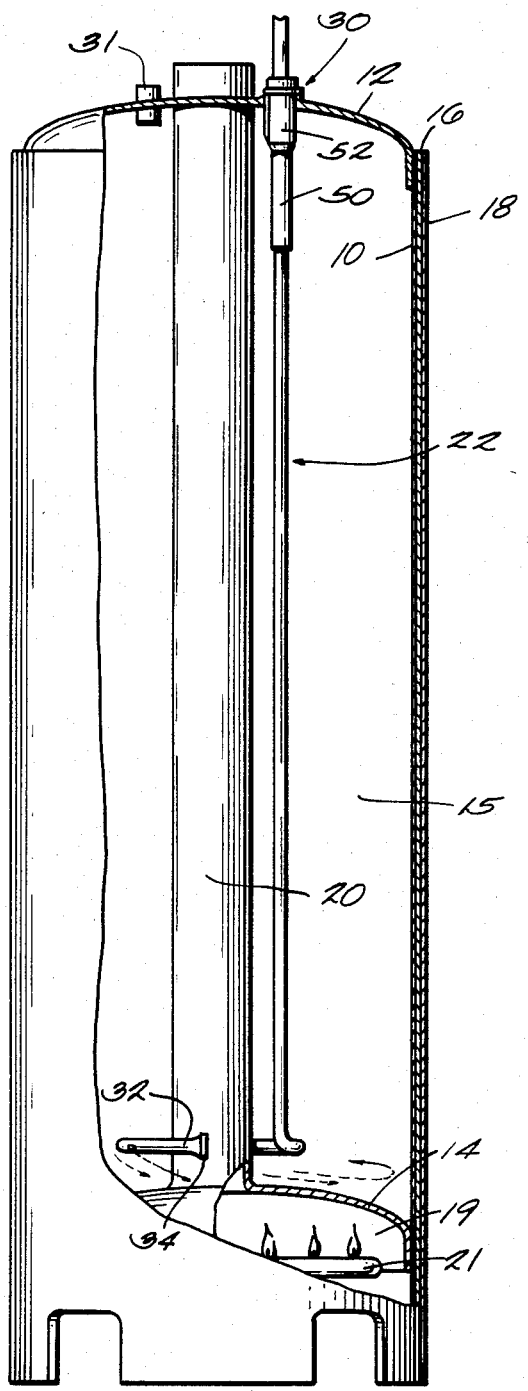
FIG. 1 is a side elevation view of a water heater with parts broken away which incorporates the inlet tube construction of the present invention.

Referring to the drawings in detail, FIG. 1 shows the water heater of the present invention, which is comprised of a tank wall 10, a top head member 12, and a bottom head member 14. Top and bottom head members 12 and 14 are sealed to the tank wall 10 by any suitable means such as welding to form a liquid-tight tank having a water heating chamber 15 therein.

The tank wall 10 is covered by a layer of insulation 16 and a jacket 18. A combustion chamber 19 is located beneath bottom head member 14 in which a burner 21 of any suitable design is mounted. The products of combustion pass upwardly through a centrally located flue tube 20 connected to bottom head 14. Flue tube 20 extends upwardly through an opening in top head 12 and is vented to atmosphere by a suitable vent means (not shown). An inlet agitator tube means 22 is mounted in chamber 15 of the water heater.

The water heater shown in FIG. 1 is a typical gas-fired residential water heater. It should be understood that the inlet tube 22 of the present invention can be used in other types of water heaters, namely, electric residential water heaters and gas and electric commercial water heaters.

Figure 2:
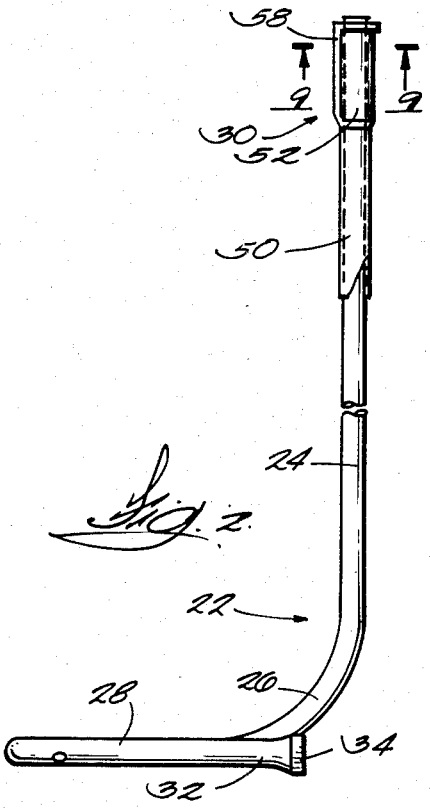
FIG. 2 is a side elevation view of the inlet tube shown in FIG. 1.
Figure 3:
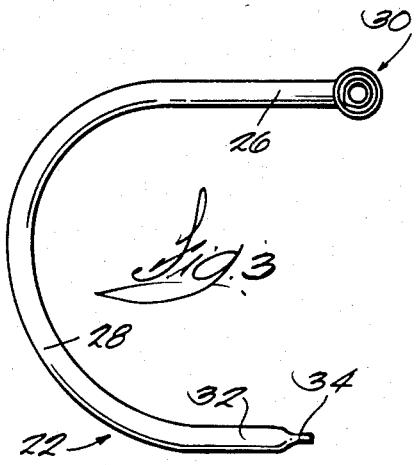
FIG. 3 is a top plan view of the inlet tube shown in FIG. 2.
Figure 4:
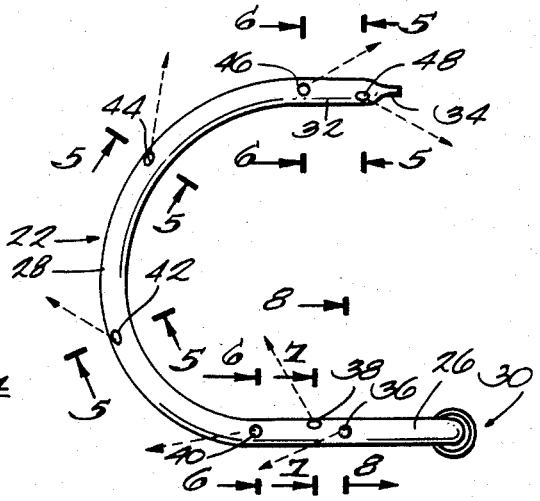
FIG. 4 is a bottom plan view of the inlet tube shown in FIG. 2.

As shown in FIGS. 2, 3, and 4, the inlet tube 22 is comprised of a straight vertical portion 24, a first curved portion 26 lying in a substantially vertical plane and a second curved portion 28 lying in a substantially horizontal plane.

A sleeve member 30 is mounted on the upper end of vertical portion 24 of inlet tube 22. The detailed construction and function of sleeve member 30 will be described hereinafter. An outlet fitting 31 of any suitable design is mounted in the top head member 12.

The first curved tube portion 26 curves for approximately 90° from the vertical to thus locate second curved portion 28 in a substantially horizontal plane. In the preferred embodiment, curved portion 28 curves approximately 180° and terminates in a short straight portion 32. The end of portion 32 is closed as indicated by reference numeral 34. In the preferred embodiment, the inlet tube 22 is made from stainless steel material.

As best shown in FIG. 4, first curved portion 22 is provided with openings 36, 38. Second curved portion 28 is provided with openings 40, 42 and 44. Straight portion 32 is provided with an opening 48. An opening 46 is located at the junction between curved portion 28 and straight portion 32.

All of the openings identified above are located so that the water flowing therefrom will be directed downwardly at an angle with respect to the horizontal plane A (FIG. 2) in which curved tube portion 28 lies.

FIGS. 5–8 show the position of the openings in the tube relative to a vertical plane passing through the axis of the tube at the location of each opening. Openings 36, 40, 46 are in the vertical plane. Openings 38, 42, 44, 48 are at an angle with respect to the vertical plane.

The dotted arrows in FIG. 4 represent the approximate direction of flow out of each opening relative to the axis of the tube at each opening. As indicated, the flow from openings 36, 40, 42, 44, 46 will be outwardly from the tube axis and the flow from openings 38 and 48 will be inwardly from the tube axis. The direction of flow from all the openings is in the same general direction as the flow through the tube itself.

Figure 5:
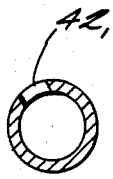
FIGS. 5–8 are sectional views taken along lines 5—5, 6—6, 7—7 and 8—8 of FIG. 4.
Figure 6:
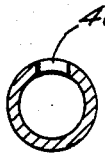
Figure 7:
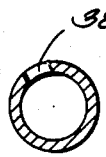
Figure 8:
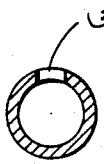

In the preferred embodiment, openings 42, 44, 48, 38 as shown in FIGS. 5 and 7 are at an angle of approximately 25°–30° from the vertical. As shown in FIG. 4, bottom head 14 is dished upwardly. In the preferred embodiment, the curved portion 28 of the inlet tube is spaced from the bottom head 14 a distance in the range of approximately 1–2.25 inches.

Figure 9:
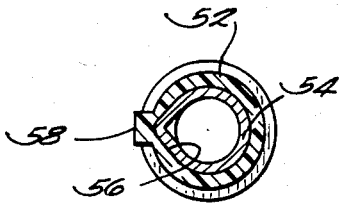
FIG. 9 is a cross-sectional view taken along line 9—9 of FIG. 2.

Sleeve member 30 is comprised of a cylindrical tail portion 50 and an enlarged head portion 52. As shown in FIG. 9, the end portion 54 of tube 22 is crimped into a tear drop cross-section to conform to the tear drop internal cross-section of head portion 52. A key portion 58 is formed on the exterior of head portion 52.

The tear drop end portion 54 of the tube 22 cooperates with the tear drop cross-section 56 of head 52 to prevent relative rotational movement of the tube 22 relative to the sleeve 30. The key portion 58 on the exterior of head 52 cooperates with a keyway (not shown) in the inlet opening in tank head 12 to prevent relative rotational movement of the sleeve 30 relative to the head 12.

The sleeve 30 serves several purposes. As indicated, when the parts are assembled, the tube 22 will be properly oriented in the tank, i.e., the curved portion 28 of the tube will be properly positioned with respect to center flue tube 20. The sleeve also serves to support and provide rigidity to the connection between the tube and the tank head. Also, the sleeve 30 is made of a non-metallic plastic material such as nylon to electrically insulate the tube 22 from the head 12 to thereby prevent the sacrificial anode (not shown) from interacting with the inlet tube 22. Finally, due to the particular shape of tube 22 as shown in the drawings, it can be installed in an assembled tank by "threading" the tube through the inlet opening in tank head 12.

OPERATION

As previously explained, a not uncommon problem in the operation of water heaters is the tendency (depending primarily on local water conditions) of certain dissolved solid materials in the water precipitating out of the water, which precipitated materials will settle out and accumulate in the bottom portion of the water heater tank. Such scale accumulations, if not periodically removed by some kind of a tank cleaning procedure, will gradually build up and harden causing an adverse effect on the heating efficiency of the unit. In many cases, such build-up will ultimately cause a premature failure of the heater tank.

The water in chamber 15 will be heated by the hot gases and products of combustion passing through flue tube 20 or in the case of an electric heater, the water will be heated by an electric heating element (not shown).

With the water heater of the present invention, each time hot water is withdrawn from chamber 15 through outlet fitting 31 into a water system, cold water will simultaneously be drawn into inlet tube 22 through inlet fitting 30 from a source of water under pressure.

The cold water drawn into the tank each time hot water is drawn off the top will be expelled into chamber 15 through openings 36, 38, 40, 42, 44, 46, 48 in the inlet tube. The water will flow out of the openings in the form of a plurality of jet-like streams. The streams of water emanating from openings 36, 40, 42, 44, and 46 will be directed downwardly and outwardly toward the tank wall. The streams of water emanating from openings 38 and 48 will be directed downwardly and inwardly from the tank wall. In all cases, the direction of flow will be in the same general direction as the water flowing through the tube itself.

The combined action of the streams emanating from all the openings will agitate the water in the bottom portion of the tank and produce a swirling action therein. In the embodiment shown and described herein, such swirling action will be in a counterclockwise direction as viewed from above.

The swirling action described above will cause solid particles which have settled to the bottom or are in the process of settling to the bottom to be swept from the bottom into suspension in the water. The normal upward circulation of the water in the tank due to the heating of the water combined with the swirling action described above will cause such suspended particles to be carried upwardly in the tank and eventually out through outlet 31. Such stirring and swirling action produced in the tank each time hot water is withdrawn therefrom has proven to be effective in reducing harmful accumulations of scale in the bottom of the tank.

Finally, it is noted that the swirling described above will occur substantially around the central flue tube 20 with the multiple streams of water flowing in an unrestricted manner into the tank. Thus, the desired sediment accumulation prevention action can be effectively accomplished with moderate inlet stream velocities. This can be compared to the inlet tube construction shown in prior U.S. Pat. No. 4,263,879 wherein the inlet tube operates in a large commercial water heater having a plurality of flue tubes spaced throughout the entire cross-sectional area of the tank. In such an environment, the velocity of the streams must be greater than with a single flue tank residential water heater of the type involved in this application.

I claim:

1. A water heater comprising:

a water tight tank means adapted to contain water under pressure, said tank means including a tank wall and a top and bottom head member;

a source of heat for heating water inside said tank means;

a hot water outlet means located in the top portion of said tank means through which hot water can be periodically withdrawn from the top portion of said tank means;

a tubular agitator means mounted in said tank, said tubular agitator means including a straight vertical portion, a first curved portion lying in a substantially vertical plane and a second curved portion lying in a substantially horizontal plane adjacent the bottom head of said tank means, said straight vertical portion having an inlet end terminating in the top of said tank means and adapted for connection to a source of water under pressure, said first curved portion having at least one opening in the underside thereof through which a stream of water is directed in the same general direction as the water flowing through the tube itself, said second curved portion extending at least 180° and having a plurality of openings therein through which streams of water will be directed into said tank means each time water is drawn out of the top portion of said tank means through said hot water outlet means, said openings in said second curved portion positioned so that some of the streams of water will be directed downwardly and outwardly toward the tank wall and other of the streams of water will be directed downwardly and inwardly from the tank wall, all of said streams being directed in the same general direction as the water flowing through the tube itself to produce a swirling action in the bottom portion of said tank means each time hot water is drawn out of said hot water outlet means, said swirling action effective to cause solid particles which have either settled to the bottom or are in the process of settling to the bottom to be swept up and maintained in suspension in the water so that ultimately at least a portion of such materials will be carried upwardly in said tank means and out said hot water outlet means.

2. A water heater according to claim 1 in which said second curved tube portion terminates in the form of a short straight end portion which is closed at its end.

3. A water heater according to claim 2 in which said short straight end portion has at least one opening therein through which a stream of water is directed in the same general direction as the water flowing through the tube itself.

4. A water heater according to claim 1 in which the axes of all of the openings in said second curved portion are either in a vertical plane or are at an acute angle with respect to a vertical plane.

5. A water heater according to claim 4 in which said acute angle is in a range of approximately 25–30°.

6. A water heater according to claim 1 in which said second curved portion of said tubular agitator means is positioned approximately 2 inches from the bottom head of said tank means.

7. A water heater comprising:

a water tight tank means adapted to contain water under pressure, said tank means including a tank wall and a top and bottom head member;

a source of heat for heating water inside said tank means;

a hot water outlet means located in the top portion of said tank means through which hot water can be periodically withdrawn from the top portion of said tank means;

a tubular agitator means mounted in said tank, said tubular agitator means including a straight vertical portion, a first curved portion lying in a substantially vertical plane and a second curved portion lying in a substantially horizontal plane adjacent the bottom head of said tank means, said straight vertical portion having an inlet end terminating in the top of said tank means and adapted for connection to a source of water under pressure, said second curved portion extending at least 180° and having a plurality of openings therein through which streams of water will be directed into said tank means each time water is drawn out of the top portion of said tank means through said hot water outlet means, said openings in said second curved portion positioned so that some of the streams of water will be directed downwardly and outwardly toward the tank wall and other of the streams of water will be directed downwardly and inwardly from the tank wall, all of said streams being directed in the same general direction as the water flowing through the tube itself to produce a swirling action in the bottom portion of said tank means each time hot water is drawn out of said hot water outlet means, said swirling action effective to cause solid particles which have either settled to the bottom or are in the process of settling to the bottom to be swept up and maintained in suspension in the water so that ultimately at least a portion of such materials will be carried upwardly in said tank means and out said hot water outlet means;

said straight tube portion having a sleeve having a sleeve mounted on the inlet end thereof, said sleeve having an internal surface means thereon which cooperates with the inlet end of the tube to prevent relative rotational movement of the tube relative to the sleeve, said sleeve further having an external surface means thereon which cooperates with a keyway in the inlet opening in the tank head to prevent relative rotational movement of the sleeve relative to the head.

8. A water heater according to claim 7 in which said sleeve is made of a non-metallic plastic material.

* * * * *

UNITED STATES PATENT AND TRADEMARK OFFICE

CERTIFICATE OF CORRECTION

PATENT NO. : 4,505,231

DATED : March 19, 1985

INVENTOR(S) : Rodney R. Syler

It is certified that error appears in the above—identified patent and that said Letters Patent is hereby corrected as shown below:

Column 6, lines 25 and 26, delete "having a sleeve".

Signed and Sealed this

*Third* Day of *September 1985*

[SEAL]

*Attest:*

DONALD J. QUIGG

*Attesting Officer* *Acting Commissioner of Patents and Trademarks - Designate*